United States Patent [19]

Hersom et al.

[11] 4,419,376

[45] Dec. 6, 1983

[54] PROCESS FOR TREATING SOLID FOODSTUFF PIECES IN A CONTAINER

[75] Inventors: Albert C. Hersom, Beaconsfield; Kenneth W. Wright, Twyford; John E. Brittain, Penn, all of England

[73] Assignee: Societe d'Assistance Technique pour Produits Nestle S.A., Lausanne, Switzerland

[21] Appl. No.: 312,957

[22] Filed: Oct. 20, 1981

[30] Foreign Application Priority Data

Nov. 14, 1980 [GB] United Kingdom ..... 8036671

[51] Int. Cl.[3] ..... A23L 3/16; B65B 1/20; B65B 55/14

[52] U.S. Cl. ..... 426/402; 53/425; 141/82; 426/403; 426/407; 426/510; 426/521

[58] Field of Search ..... 426/397, 407, 402, 403, 426/404, 510, 521; 53/425, 432, 417, 255; 141/81

[56] References Cited

U.S. PATENT DOCUMENTS

| | | | |
|---|---|---|---|
| 2,745,755 | 5/1956 | Anderson | 426/403 |
| 3,234,707 | 2/1966 | Weston | 53/510 |
| 3,984,580 | 10/1976 | Gur-Arieh et al. | 426/399 |
| 4,156,741 | 5/1979 | Beauvais et al. | 426/402 |

*Primary Examiner*—Steven L. Weinstein
*Assistant Examiner*—George C. Yeung
*Attorney, Agent, or Firm*—Vogt & O'Donnell

[57] ABSTRACT

A process for treating solid foodstuff pieces in a container which is to be hermetically sealed characterized in that the container is extended by means of an extension piece, solid foodstuff pieces are added so that they fill the container and at least part of the extension piece, the extended container is fitted with a closing member to form a closed assembly provided with an outlet for the escape of air, the contents are purged with steam until they have shrunk to such an extent that the foodstuff pieces in the extension piece have subsided into the container and the required degree of heat processing has been achieved after which the container, extension piece and closing member are separated from each other.

16 Claims, 7 Drawing Figures

PROCESS FOR TREATING SOLID FOODSTUFF PIECES IN A CONTAINER

Figure 1:
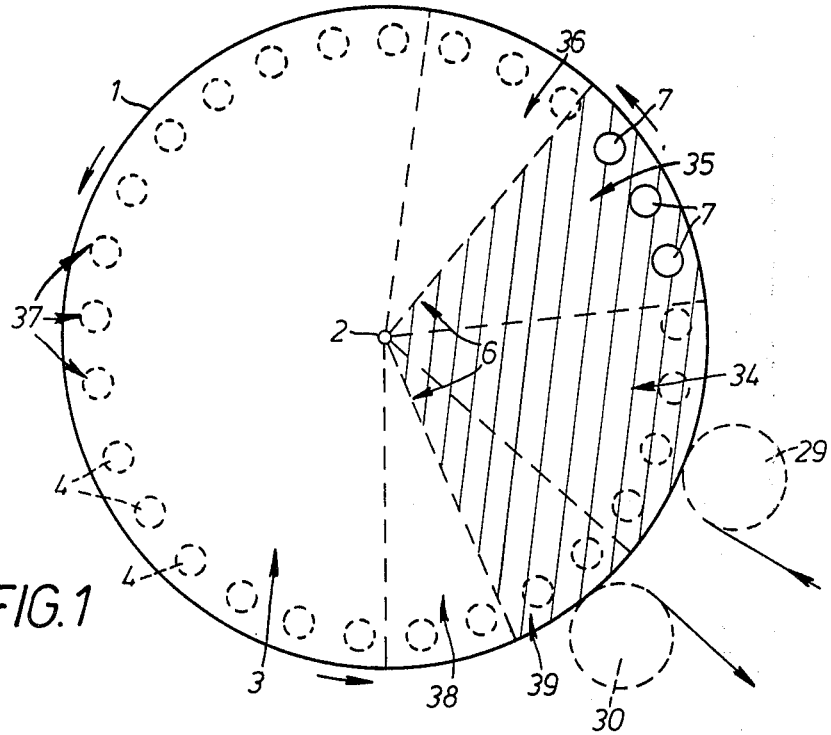

The present invention relates to a process and apparatus for sterilising, pasteurising or blanching a foodstuff within a container which is to be hermetically sealed.

Food particles may be sterilised, pasteurised or blanched within a can by purging the interstices between the pieces of food with saturated steam and maintaining the steam environment within the can and around the pieces of food for a period of time sufficient to enable the heat to penetrate each particle. While this is taking place, air and vapours are vented out of the can. The temperature may be regulated by controlling the pressure of the saturated steam and according to the temperature and pressure selected, the particles of food may be pasteurised, sterilised or merely blanched in preparation for a subsequent processing operation.

The steam required for the above operation may either be generated externally and admitted to the can by means of injection nozzles which are brought into position in the can or it may be generated in the can itself by evaporating a small amount of water filled into the can especially for this purpose.

In order to avoid re-infection of the can after treatment, the end is normally positioned on the can before the heating operation is carried out. However the can cannot be hermetically sealed because if it were, venting of the air would not take place. One procedure which is sometimes practised is to "clinch" the end in place, thus providing mechanical retention but enabling air and vapours to escape. On completion of this "venting" operation, the final sealing operation is carried out by tightening the seam of the can by a second operation. Such a process is described in British Pat. No. 1,400,038.

There are two main disadvantages associated with the above procedure where the can end is clinched in position when the heating operation is carried out.

1. Shrinkage of the solids often takes place on heating and this gives rise to a canned product which is underfilled and since the can end is already clinched in position, it is not possible to rectify the situation by topping up with food.

2. Collapse of the steam in the can gives rise to an extremely high vacuum when the can is cooled. Whilst the removal of air is desirable to prevent or reduce oxidation, the high vacuum often results in deformation of the can due to the pressure differential between the inside of the can and the atmosphere. Again, since the can end is clinched in position, it is difficult to replace part of the steam in the headspace by other gases in order to relieve the vacuum.

We have surprisingly found that in a process in which steam is used for sterilising, pasteurising or blanching a foodstuff in a container, if instead of clinching the container end in position after adding the foodstuff, the container is first provided with a temporary extension and after adding the foodstuff a closing member is connected, both the aforementioned disadvantages may be overcome.

According to the present invention, there is provided a process for treating a foodstuff in a container which is to be hermetically sealed characterised in that the container is extended by means of an extension piece, foodstuff is added so that it fills the container and at least part of the extension piece, the extended container is fitted with a closing member to form a closed assembly provided with an outlet for the escape of air, the contents are purged with steam until they have shrunk to such an extent that the foodstuff in the extension piece has subsided into the container and the required degree of heat processing has been achieved, after which the container, extension piece and closing member are separated from each other.

The container may be conical or spherical but is preferably cylindrical or substantially cylindrical, for example a can, bottle or jar: it may be of metal, glass or thermoplastic material.

The container preferably contains no solid foodstuff before it is extended by means of the extension piece. The extension piece may be of substantially hollow cylindrical form for example, a sleeve, and is conveniently adapted to engage and seal with the container, preferably with the rim of open end of the container. Since different foodstuffs shrink to different degrees during the treatment, the length of the extension piece may vary depending upon the foodstuff being processed. Preferably, the length of the extension piece corresponds to the extent of shrinkage of the foodstuff which is preferably added to fill substantially the whole of the container and the extension piece. The foodstuff may be introduced by conventional means for example by gravity filling, conveniently through an aperture in a filling platform. In this case, the extension piece may advantageously take the form of an insert engaging with the perimeter of the aperture in the filling platform.

The closing member may engage and seal with the extended container, conveniently with the upper end of the extension piece. The outlet for the escape of air may be provided by an opening or channel in the closing member. The closing member may also be fitted with a thermocouple or other temperature measuring probe to measure the temperature within the container or in its headspace.

The steam used in the process of the invention may for example be generated externally. In this case, the closing member may be provided with injection nozzles for entry of the steam into the closed assembly. Advantageously, the closed assembly is spun to ensure that condensate does not accumulate at the bottom of the can, and optionally, external heat may be applied. If desired a vacuum may be applied to the container before admission of the steam which upon entry, replaces the air which has been removed and reaches the interstices between the solid pieces of food.

However the steam is most preferably generated inside the container. This is achieved by adding a small amount of aqueous liquid, preferably water, to the container, preferably before introducing the foodstuff, and afterwards heating and spinning the closed assembly of container, extension piece and closing member to evaporate the aqueous liquid. The heating is preferably carried out by applying naked gas flames to the wall of the container.

Expediently, the spinning of the closed assembly is performed simultaneously with the application of heat, preferably about a vertical axis and desirably at a speed which, by virtue of the centrifugal force, creates on the inside vertical wall of the container, a thin film of liquid which is vapourised by the heat. If the extension piece is engaged with the filling platform, it is disengaged temporarily so that the closed assembly is free to spin. The extension piece is sealed at the top by the closing member and at the bottom with the container and the engagement of the components of the closed assembly should be sufficiently firm to ensure that they spin synchronously.

During the treatment with the steam, air and vapours are forced out of the container through the outlet for the escape of air.

The temperature may be regulated by controlling the pressure of the steam issuing from the outlet, for example by means of a valve, and according to the temperature and pressure selected the foodstuff may be pasteurised, sterilised or blanched. If desired, evaporative cooling of the product may also be achieved by applying or generating a partial vacuum within the container. A convenient method of generating the internal vacuum is to close the outlet and then to collapse the steam by cooling the container, for example, by external water spray.

After the required degree of heat processing has been achieved and the foodstuff has subsided into the container, the steam in the headspace may be replaced by air or non-oxidising gas such as carbon dioxide or nitrogen which may conveniently be introduced through the outlet. This operation may be carried out either as a non-aseptic operation or as an aseptic operation. In the latter case the gas used would be rendered sterile by filtration or other means. If desired a sterile sauce or liquor may also be added, conveniently through the outlet. The parts of the closed assembly are then separated from each other and the container transferred to the seamer in a manner which may or may not be aseptic.

Alternatively after the heat processing operation, the parts of the closed assembly may be separated from each other and the container transferred to an equilibration zone where steam in the headspace may be replaced by air or a non-oxidising gas such as carbon dioxide or nitrogen which, in an aseptic operation, has previously been sterilized: if the foodstuff has previously been heated to a temperature in excess of the boiling point corresponding to atmospheric pressure, then the gas may be required to be pressurised in order to avoid boiling within the solid pieces. If desired, a sterile sauce or liquor may be added to the processed food in the container in the sterile environment of the equilibration zone. If the operation is non-aseptic, the container is transferred directly to the seamer where gas may be admitted immediately prior to applying and seaming the end in place. If the operations are not carried out in an aseptic manner and the foodstuff is not acidic, i.e. not having a pH below 4.5, then the closed container and contents must undergo a subsequent thermal process to effect sterilisation.

The present invention also provides an apparatus for treating a foodstuff in a container which is to be hermetically sealed which comprises means for supporting a container, an extension piece adapted to temporarily extend the container, means for introducing foodstuff into the extended container, a closing member adapted to temporarily fit the extended container to form a closed assembly provided with an outlet for the escape of air, means for purging steam through the contents therein and means for separating the container, extension piece and closing member from each other.

The means for supporting the container may suitably be a supporting table on which the container may be positioned.

Conveniently, the means for introducing foodstuff is provided by an aperture in a filling platform.

The outlet for the escape of air may conveniently be an opening or channel in the closing member.

The means for purging steam through the contents may be provided by fitting the closing member with injection nozzles through which steam, which has been generated externally, can enter the closed assembly. Alternatively, the steam may be generated by evaporating a small amount of water inside the container, in which case a heat source, preferably naked gas flames, is provided to apply heat to the container. Moreover means are provided for spinning the closed assembly about a vertical axis simultaneously with the heating process.

Means may be provided for admitting air or inert gas, and means for admitting a sauce or liquor to the closed assembly and conveniently both these means are provided by the outlet for the escape of air. Means may be provided for raising the container so that it engages the extension piece to form the extended container, for example the supporting table on which the container is positioned located directly beneath the extension piece. Means may also be provided for lowering the closing member to form the closed assembly. Both these means may be cam action.

The extension piece may conveniently engage with the perimeter of the aperture in the filling platform in which case means may be provided for disengaging it therefrom after filling the extended container so that the closed assembly is free to spin: conveniently such means are provided by the supporting table which further raises the filled container engaged with the extension piece. Spinning of the container may be achieved by providing a means for rotating either the supporting table, the closing member or the extension piece.

The means for separating the container, extension piece and closing member from each other whereby the container is lowered and the closing member is raised is suitably carried out by the same means as those used for raising the container and lowering the closing member to form the closed assembly. For example the container which was originally raised by the ascent of the supporting table is lowered by the descent of the supporting table on which it is still positioned.

In addition to the means for raising, lowering and spinning the container, means may also be provided for conveying the container horizontally to the successive work stations viz. engagement with the extension piece, filling of the extended container, engagement of the extended container with the closing member, heating and spinning and finally disengagement from the extension piece and closing member. Advantageously, provision is made for conveying a plurality of containers consecutively to the successive work stations to give a continuous process, for example by a movable filling platform.

In such a continuous process the apparatus is advantageously a rotary machine having a rotatable substantially horizontal filling platform provided with a plurality of apertures each engaging with an extension piece above which is a plurality of closing members and below which is a plurality of supporting tables, the closing members and the supporting tables being rotatable synchronously with the filling platform and one of each being in vertical alignment with an extension piece Preferably, a stationary filling table provided with apertures is situated immediately above the filling platform in the area of the machine where the extension pieces are not engaged with the closing members to allow addition of foodstuff to the extended container at a filling zone when the apertures of the filling platform come into alignment with those of the filling table.

Advantageously a transfer device such as a chain or a starwheel is provided for conveying a container to the apparatus, for example, by positioning it on a supporting table, and a similar device for removing the filled and processed container from the apparatus and conveying it either directly, to the seamer or to an intermediate station. In a continuous process one transfer device may convey a plurality of containers consecutively to the apparatus while another transfer device removes the containers containing processed foodstuff consecutively from the apparatus.

The process and apparatus of the invention are applicable to a wide variety of food materials, especially fruit and vegetables. Compared with conventional methods, a much shorter treatment with steam is required to obtain a stable product which thus has a much better flavour and texture. Direct heating within the container is much more economical and there are no effluent problems.

The present invention will now be further described by way of example with reference to the accompanying drawings in which:

FIG. 1 is a top plan diagrammatic view of a rotary machine suitable for a continuous process together with two transfer devices, looking downwards from a position just above the filling table.

Figure 2:
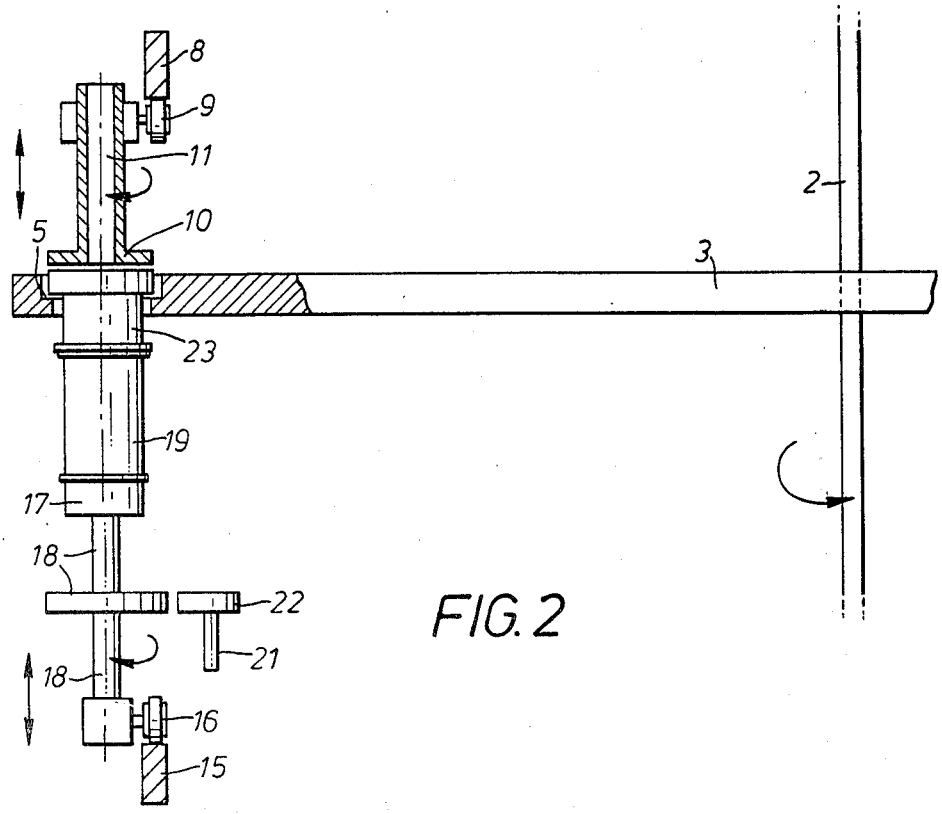
Figure 3:
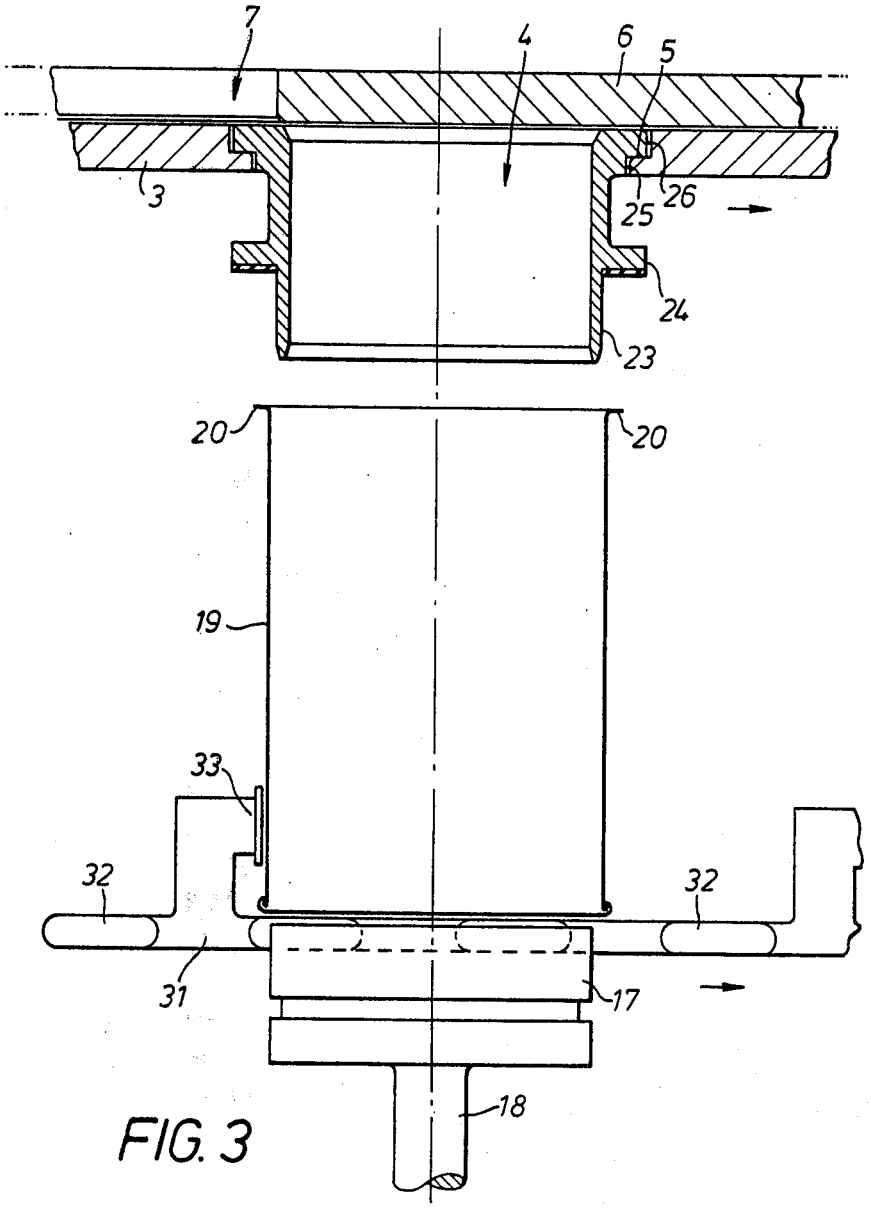
Figure 4:
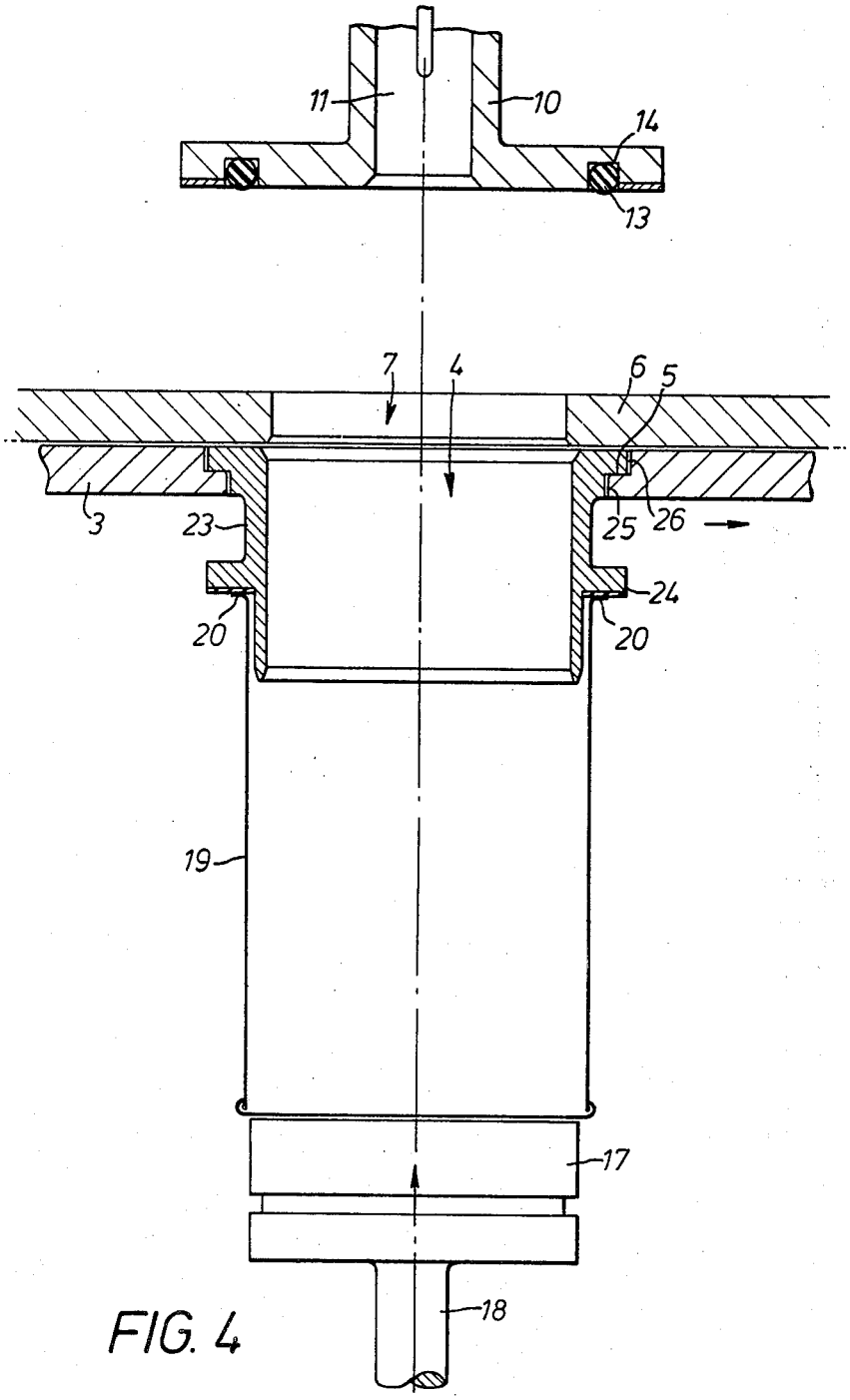
Figure 5:
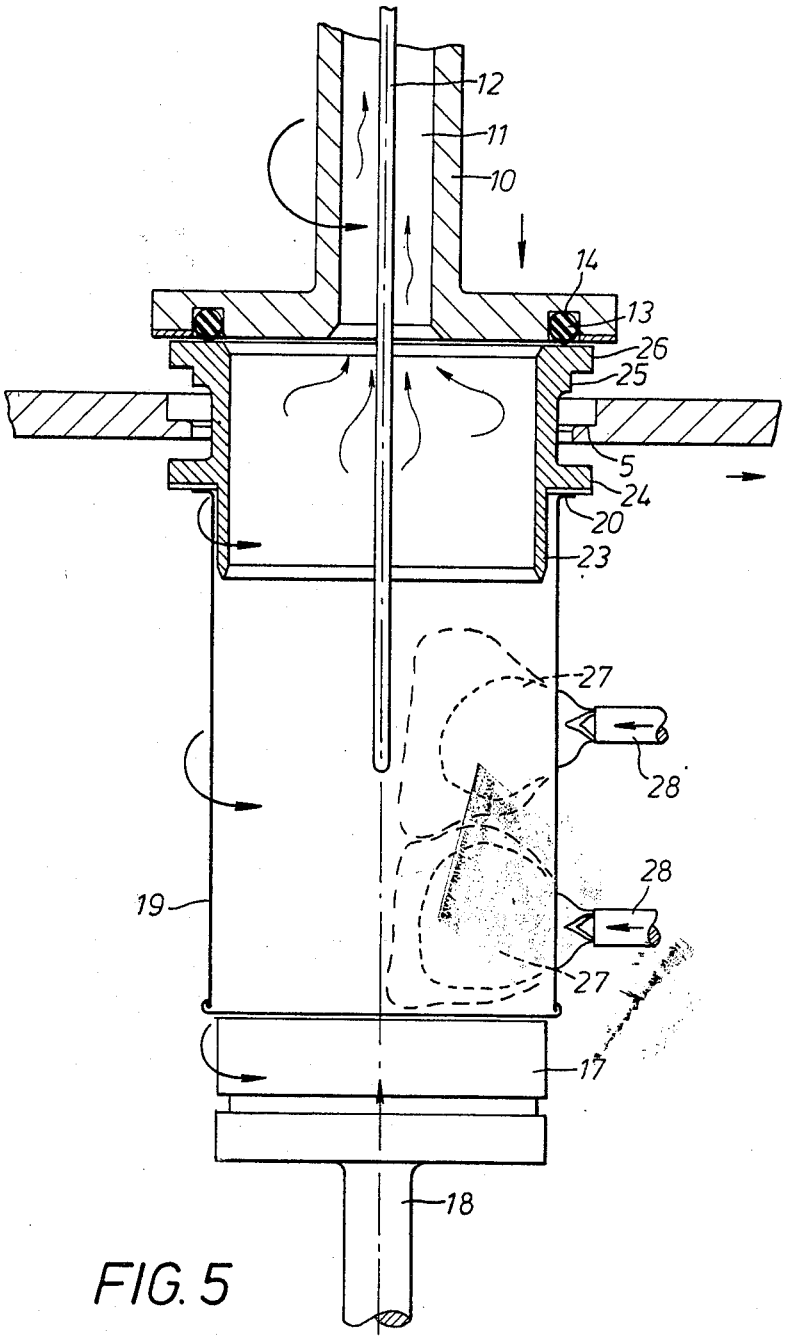
Figure 6:
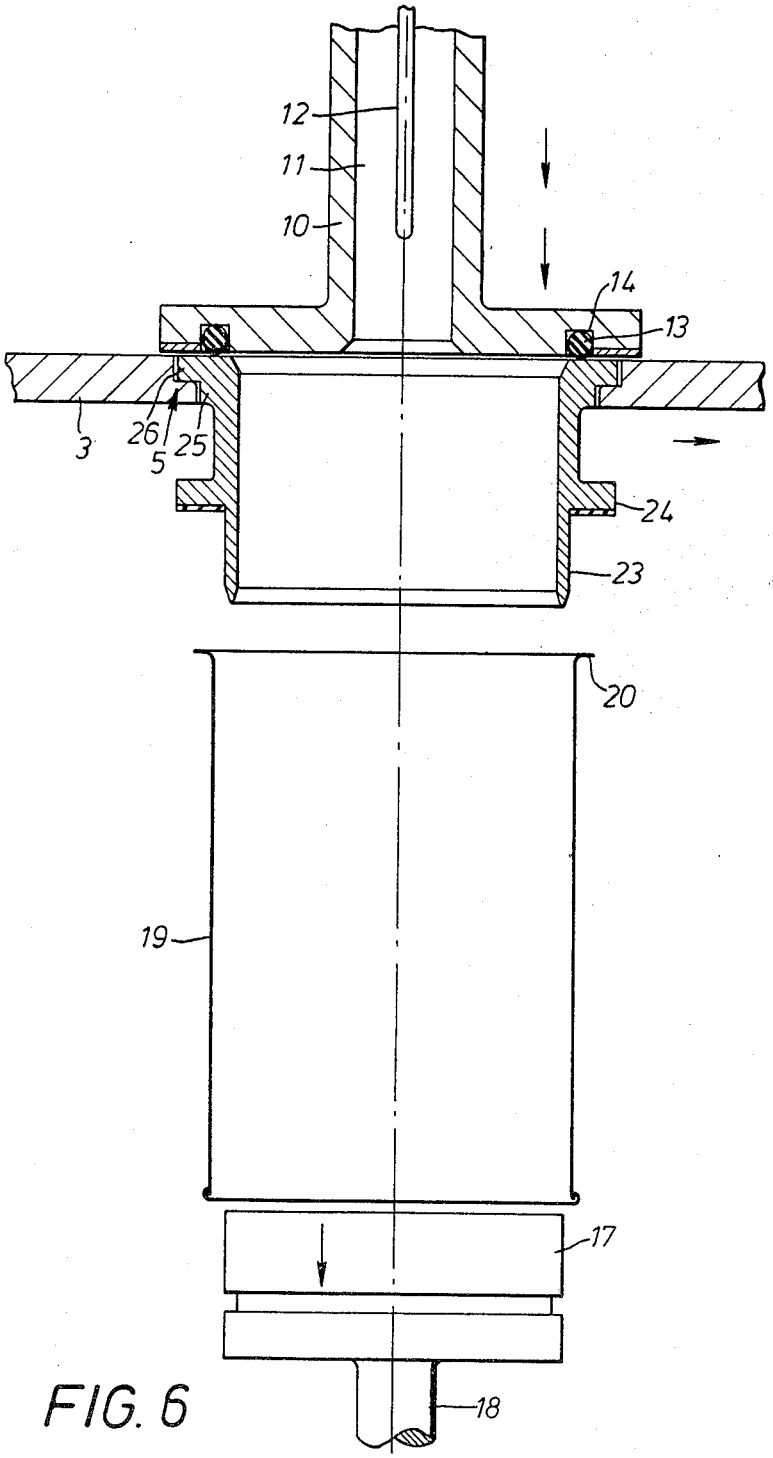
Figure 7:
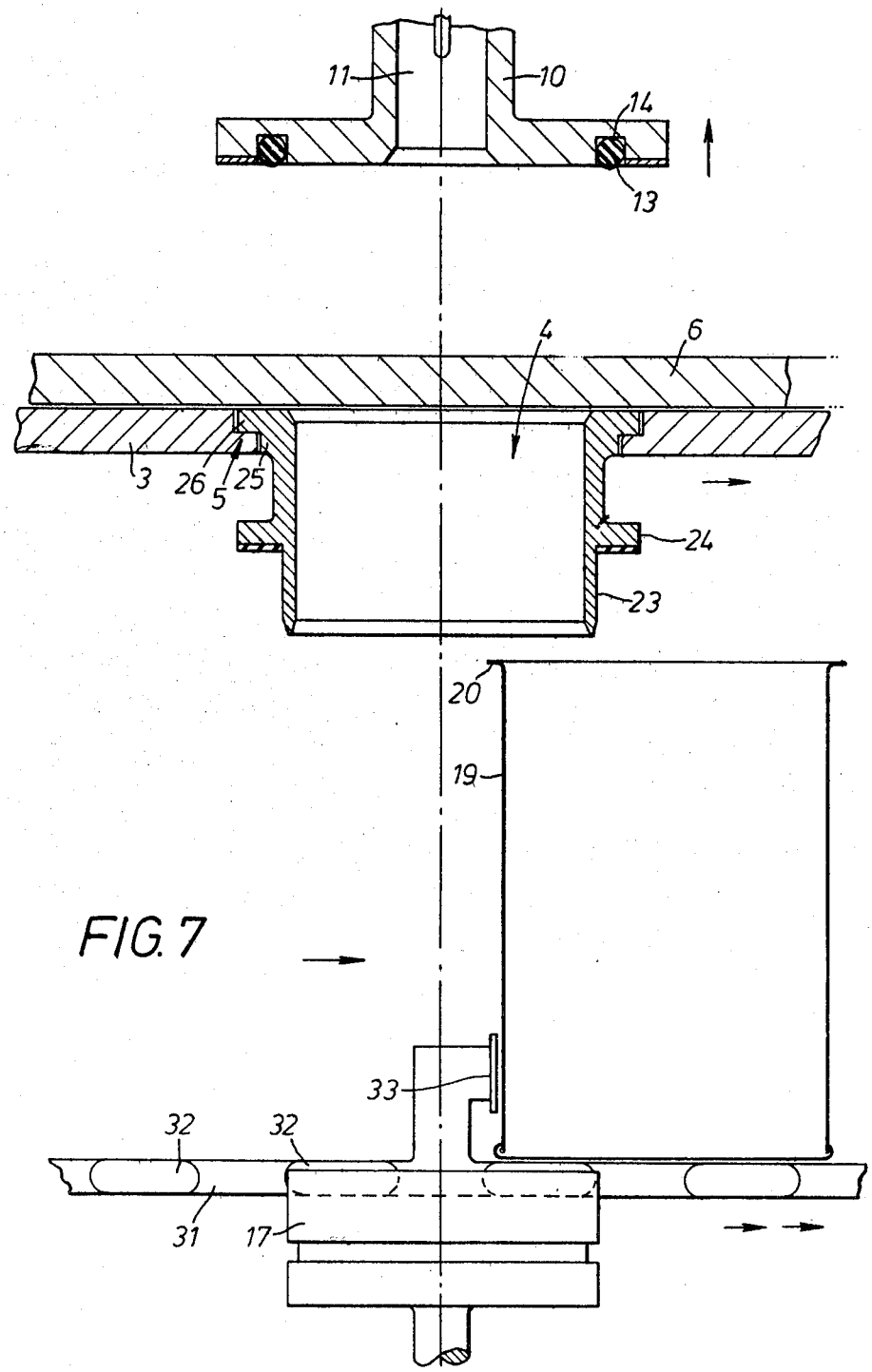

FIG. 2 is a section along a radius of the rotary machine through a closed assembly during spinning, FIGS. 3 to 7 are side sectional views of a single can in successive work positions on the rotary machine, in which FIG. 3 shows the can positioned beneath the extension piece before engagement therewith, FIG. 4 shows the extended container during filling, FIG. 5 shows the closed assembly during spinning and heating, FIG. 6 shows the filled container disengaged from the extension piece and FIG. 7 shows the separated components with the filled processed can being conveyed to the next stage.

Referring to the drawings, the rotary machine 1 has a shaft 2 integral with and at the centre of a circular filling platform 3 provided with apertures 4 each having a rim 5. Immediately above the filling platform 3 is a filling table 6 provided with apertures 7. Concentric with the shaft 2 is a fixed upper circular cam rail 8 running on which are cam followers 9 driving a plurality of closing members 10 each in vertical alignment with an aperture 4 of filling platform 3. Each closing member which is free to rotate about its vertical axis has a central hollow core 11, and is fitted with a thermocouple 12 and gasket 13 in an annular slot 14.

Also concentric with the shaft 2 is an adjustable lower circular cam rail 15 running on which are cam followers 16 driving a plurality of supporting tables 17 each in vertical alignment with an aperture 4 of filling platform 3. Each supporting table 17, which is free to rotate about its vertical axis, is provided with a shaft 18 and supports a can 19 having a rim 20.

A further circular cam rail 21 concentric with the shaft 2 carries a friction drive 22. A plurality of extension pieces 23 each provided with a gasket 24 and annular projections 25 and 26 engage with the annular rim 5 of an aperture 4 of the filling platform 3. The rotary machine 1 is provided with naked gas flames 27 from burners 28 and is also provided with transfer devices 29, 30 each having a chain 31, rollers 32 and push bars 33.

The rotary machine has a can entry and positioning zone 34, filling zone 35, engagement zone 36, spinning and heating zone 37, disengagement zone 38 and can outlet zone 39.

In operation the shaft 2 motivated by a drive (not shown) rotates the filling platform 3. Closing members 10 and supporting tables 17 are integral with platform 3 and are individually mounted as shown diagramatically in FIG. 2. Both the supporting tables and the closing members can be positioned in the vertical plane for the appropriate operation. The vertical movements of the closing members 10 and the supporting table 17 are governed by cam followers 9 and 16 running on non-rotating cam rails 8 and 15 which are adjustable to allow the variation in the height of cans 19 or extension piece 23. The transfer device 29 conveys cans 19 to which a small amount of water has been added, consecutively to the can entry zone 34 of the rotary machine and positions each one on a supporting table 17 by means of its chain 31, rollers 32 and push bars 33. The supporting table gradually rises through the action of the cam follower 16 running on the lower circular cam rail 15, to lift the can 19 so that its flange 20 engages with and is held against the gasket 24 of the extension piece 23. The filling platform 3 continues to rotate and carries the can 19 with its extension piece 23 to the filling zone 35. Here the aperture 4 is in alignment with aperture 7 of the filling table 6, whereupon a foodstuff is added where it fills to the top of the extension piece. The filling platform continues to rotate until the extended can passes beyond the edge of the filling table to the engagement zone 36 where the supporting table 17 is further lifted by the action of the cam follower 16 running on the circular cam rail 15 and pushes the extended can upwards causing the annular projections 25 and 26 of the extension piece to disengage from the annular rim 5 in the aperture of the filling platform so that the extended can still positioned on the supporting table is in the free rotating position. At the same time the closing member 10 driven by the cam follower 9 running on the upper circular cam rail 8 descends to engage and temporarily seal the top of the annular projection 26 of the extension piece 23 against the gasket 13 in the annular slot 14 to form a closed assembly. In the meantime the filling platform 3 carries the closed assembly to the spinning and heating zone 37 where gas flames 27 from burners 28 are applied to the can wall while the closed assembly is spun rapidly by means of the friction drive 22 applied to the shaft 18 of the supporting table 17. The steam generated pushes air out through the central core 11 of the closing member 10. After the required heating time the spinning is discontinued and the closed assembly is conveyed away from the heating and spinning zone by the continuing rotation of the filling platform 3 to the disengagement zone 38 whereupon the supporting table 17 descends simultaneously with the closed assembly due to the action of the cam followers 16 and 9 running on cam rails 15 and 8 respectively until the extension piece 23 returns to its original position where it engages with the rim 5 of the aperture 4 of the filling platform 3. The supporting table continues to descend and the can (filled with hot foodstuff) disengages from the extension piece while the closing member 10 disengages from the extension piece and ascends to its original position. The continuing rotation of the platform conveys the extension piece and the can (still positioned on the supporting table) to the can outlet zone 39 beneath the filling table where the transfer device 30 conveys the can out of the rotary machine by means of the chain 31, rollers 32 and push-bars 33 to the next stage.

Those operations are repeated successively on each consecutive can conveyed by transfer device 29 into the rotary machine.

We claim:

1. A process for treating solid foodstuff pieces in a container which is to be hermetically sealed comprising:

(a) extending the container by providing an extension piece to engage with the container;

(b) adding solid foodstuff pieces to the container to fill the height of said container and at least part of the extension piece above the rim of said container;

(c) providing a closing member to engage with the extended container to form a closed assembly which contains an outlet for the escape of air;

(d) purging the solid foodstuff pieces with steam which reaches the interstices between the said pieces until the desired degree of heat processing has been achieved and the foodstuff pieces shrink and subside from the extension piece into the container; and then (e) removing and separating the extension piece and closing member from the container.

2. A process according to claim 1, wherein the extension piece engages and seals with the rim of the open end of the container.

3. A process according to claim 1 or claim 2, wherein the length of the extension piece corresponds to the extent of shrinkage of the solid foodstuff pieces which are added to fill substantially the whole of the container and the extension piece.

4. A process according to claim 1, wherein the closing member engages and seals with the upper end of the extension piece.

5. A process according to claim 1, wherein the air can escape from the closed assembly through an opening or channel provided in the closing mermber.

6. A process according to claim 1, wherein the steam is generated inside the container by adding a small amount of aqueous liquid to the container and applying heat to the closed assembly of container, extension piece and closing member.

7. A process according to claim 6, wherein the heating is carried out by applying naked gas flames to the wall container.

8. A process according to claim 6 or claim 7, wherein the closed assembly is spun about a vertical axis at a speed which, by virtue of the centrifugal force, creates on the inside vertical wall of the container, a thin film of liquid which is vapourised by the heat.

9. A process according to claim 1, wherein after the desired degree of heat processing has been achieved, the steam in the headspace is replaced by air or a non-oxidising gas which is introduced through the outlet before the extension piece and closing member are removed and separated.

10. A process according to claim 9, wherein the gas used has previously been sterilised.

11. A process according to claim 9 or claim 10, wherein a sterile sauce or liquor is added to the closed assembly through the outlet.

12. A process according to claim 1, wherein after removal and separation and before transfer to a seamer the container is transferred to an equilibration zone where steam in the headspace is replaced by air or a non-oxidising gas.

13. A process according to claim 12, wherein the gas used has previously been sterilised.

14. A process according to claim 12 or claim 13, wherein a sterile sauce or liquor is added to the container.

15. A process according to claim 1, wherein in a non-aseptic operation, the container is transferred directly to a seamer where gas is admitted immediately prior to applying and seaming the end in place.

16. A process according to claims 12 or 15 carried out in a non-aseptic manner wherein after seaming, the closed container and contents undergo a subsequent thermal process to effect sterilisation.

* * * * *